US008346114B2

(12) United States Patent
Sakata

(10) Patent No.: US 8,346,114 B2
(45) Date of Patent: Jan. 1, 2013

(54) IMAGE FORMING APPARATUS AND HIGH VOLTAGE OUTPUT POWER SOURCE

(75) Inventor: Shiro Sakata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 12/187,214

(22) Filed: Aug. 6, 2008

(65) Prior Publication Data

US 2009/0052932 A1 Feb. 26, 2009

(30) Foreign Application Priority Data

Aug. 22, 2007 (JP) ..... 2007-216125

(51) Int. Cl.
*G03G 15/00* (2006.01)

(52) U.S. Cl. ..... 399/88; 399/89; 399/90

(58) Field of Classification Search ..... 399/88, 399/89, 90; 323/283, 267, 322
See application file for complete search history.

(56) References Cited

U.S. PATENT DOCUMENTS

| | | | | |
|---|---|---|---|---|
| 4,166,690 | A * | 9/1979 | Bacon et al. | 399/89 |
| 4,305,651 | A * | 12/1981 | Umezawa et al. | 399/89 |
| 4,891,572 | A * | 1/1990 | Suzuki | 323/284 |
| 4,945,255 | A * | 7/1990 | Suzuki et al. | 307/17 |
| 5,444,519 | A * | 8/1995 | Motoyama et al. | 399/50 |
| 5,499,080 | A * | 3/1996 | Furuya et al. | 399/50 |
| 5,568,226 | A * | 10/1996 | Kusano | 399/88 |
| 5,903,183 | A | 5/1999 | Inukai | |
| 6,908,164 | B2 * | 6/2005 | Gilbert et al. | 347/5 |
| 7,548,708 | B2 * | 6/2009 | Nagasaki et al. | 399/88 |
| 7,619,399 | B2 * | 11/2009 | Cho et al. | 323/283 |
| 7,711,278 | B2 * | 5/2010 | Sakata | 399/50 |
| 2005/0013626 | A1 * | 1/2005 | Satoh et al. | 399/88 |
| 2006/0238175 | A1 * | 10/2006 | Cho et al. | 323/234 |
| 2008/0031651 | A1 * | 2/2008 | Watanabe et al. | 399/88 |
| 2010/0196043 | A1 * | 8/2010 | Hamaya | 399/88 |

FOREIGN PATENT DOCUMENTS

| | | |
|---|---|---|
| JP | 06-003932 A | 1/1994 |
| JP | 09-179383 A | 7/1997 |
| JP | 10-032979 A | 2/1998 |

* cited by examiner

*Primary Examiner* — David Porta
*Assistant Examiner* — Casey Bryant
(74) *Attorney, Agent, or Firm* — Canon USA, Inc., IP Division

(57) ABSTRACT

A power source includes a voltage setting unit configured to set an output voltage, a voltage generation unit configured to output the set voltage to a load, a feedback unit configured to detect the output voltage and feed back the detected voltage to the voltage setting unit, a current detection unit configured to detect a current value which is a sum of a current value flowing in the feedback unit and a current value flowing in the load when the set voltage is output to the load, and a control unit configured to switch between a constant current control which controls the set voltage so that the detected current value becomes a constant current, and a constant voltage control which controls the set voltage so that the voltage output to the load becomes a constant voltage based on the voltage value that is fed back by the feedback unit.

14 Claims, 13 Drawing Sheets

IMAGE FORMING APPARATUS AND HIGH VOLTAGE OUTPUT POWER SOURCE

BACKGROUND OF THE INVENTION

1. Field of the Invention

The present invention relates to a high-voltage power source which is applicable to an image forming apparatus such as a copying machine or a printer.

2. Description of the Related Art

Conventionally, a copying machine, an inkjet printer, a laser beam printer and the like are known as an image forming apparatus which forms an image on a sheet. FIG. 11 illustrates a configuration of a laser beam printer which will be described below as an example of an image forming apparatus.

Referring to FIG. 11, in the laser beam printer, a photosensitive drum 101 is an electrostatic latent image carrier, and a semiconductor laser 102 is used as a light source for forming an electrostatic latent image on the photosensitive drum 101. A motor 104 rotates a rotational polygon mirror 103, and a laser beam 105 emitted from the semiconductor laser 102 scans the photosensitive drum 101. A charging roller 106 is a charging member which nearly uniformly charges a surface of the photosensitive drum 101. A developing unit 107 develops the electrostatic latent image formed on the photosensitive drum 101 using a toner as a developer. A transfer roller 108 is a transfer member for transferring a toner image developed by the developing unit 107 on a sheet. A fixing roller 109 serves as a fixing unit for fusing a toner image transferred on a sheet with heat and pressure. A process cartridge 100 in which the photosensitive drum 101, the charging roller 106, and the developing unit 107 are integrated is detachably mounted on the image forming apparatus.

A first feeding roller 110 rotates once to feed a sheet one by one from a cassette 127. The cassette 127 includes a function (not illustrated) for identifying a sheet size. A manual feeding roller 111 feeds a sheet to a conveyance path from a manual feed port (not illustrated) that does not include a function for identifying a sheet size. A second feeding roller 112 feeds a sheet to the conveyance path from a cassette 128 that is an optional feeding device detachably attached to the image forming apparatus. An envelope feeding roller 113 feeds one envelope at a time to the conveyance path, from an envelope feeder (not illustrated) that is detachably attached and can only stack envelopes. Conveyance rollers 114 and 115 convey a sheet that is fed from each of the cassettes 127 and 128.

A sheet detection sensor 116 detects a sheet which is fed from a source other than the envelope feeder, and a conveyance roller 117 feeds the conveyed sheet to the photosensitive drum 101. A sheet position detection sensor 118 synchronizes a leading position of the fed sheet with an image writing position (recording/printing) of the photosensitive drum 101. At the same time, the sheet position detection sensor 118 measures a length of the fed sheet in a conveying direction (by detecting a leading edge and a trailing edge). A sheet discharge sensor 119 detects whether there is a sheet after fixing an image, and a discharging roller 120 discharges a sheet on which an image is fixed to outside of the apparatus.

A flapper 121 switches a conveying destination of a printed sheet. The printed sheet can be conveyed to a discharge tray (not illustrated) on which the sheet is discharged in a face-down state (i.e., with a printed side facing downward) in an outside of the apparatus. The printed sheet can also be conveyed to a two-sided conveyance path 129 for reversing and conveying the sheet to form an image on both sides of the sheet.

A conveyance roller 122 conveys a sheet conveyed to the two-sided conveyance path 129 to a reversing unit (not illustrated), and a sensor 123 detects the sheet conveyed to the reversing unit. A reverse conveyance roller 124 reverses the sheet at a predetermined timing and feeds the sheet to the two-sided conveyance path 129. A sensor 125 detects the sheet at the two-sided conveyance path 129, and a conveyance roller 126 feeds the reversed sheet to the conveyance path for performing image formation again. The two-sided conveyance path 129, the conveyance roller 122, the reverse conveyance roller 124, the conveyance roller 126, and the sensor 125 are unitized as a two-sided conveyance unit 130 which is detachably attached to the image forming apparatus.

FIG. 12 illustrates a block diagram of a control circuit for controlling the image formation of the above-described image forming apparatus.

Referring to FIG. 12, a printer controller 201 includes a function for rasterizing code data of an image sent from an external device such as a host computer (not illustrated) into bit map data which is necessary for printing. The printer controller 201 reads information about an internal status of a printer (e.g., information about sheet conveyance status or whether there is sheet inside a cassette) and instructs and manages a printer operation based on the read information. Further, the printer controller 201 includes a function for displaying the read printer status.

An engine control unit 202 controls various units of a printer engine according to an instruction from the printer controller 201. The engine control unit 202 includes a function for notifying information about the internal status of the printer to the printer controller 201. A sheet conveyance control unit 203 drives and stops a driving unit (e.g., motor, not illustrated) of conveyance rollers for conveying a sheet according to an instruction from the engine control unit 202. A high-voltage control unit 204 controls high voltage output in a charging operation by a charging roller, a developing operation by a developing unit, and a transferring operation by a transfer roller respectively, according to an instruction from the engine control unit 202. An optical system control unit 205 controls the driving and stopping of the motor 104 and emission of a laser beam 105 according to an instruction from the engine control unit 202. A sensor input unit 206 inputs an output from sensors 116, 118, 119, 123 and 125. A fixing temperature control unit 207 adjusts a temperature of a fixing unit to a temperature designated by the engine control unit 202.

An option cassette control unit 208 controls an operation of a detachably attached option cassette. The option cassette control unit 208 drives and stops a driving system of the option cassette according to an instruction from the engine control unit 202 and sends information about whether there is sheet in the option cassette and sheet size.

A two-sided conveyance unit control unit 209 controls an operation of the two-sided conveyance unit 130 that is detachably attached to the image forming apparatus. The two-sided conveyance unit control unit 209 performs a sheet reversing and re-feeding operation inside the two-sided conveyance unit 130 according to an instruction from the engine control unit 202. Further, the two-sided conveyance unit control unit 209 sends an operation status of the two-sided conveyance unit 130 to the engine control unit 202.

An envelope feeder control unit 210 controls an operation of an envelope feeder which is detachably attached to the image forming apparatus. The envelope feeder control unit 210 drives and stops a driving system of the envelope feeder according to an instruction from the engine control unit 202. Further, the envelope feeder control unit 210 sends information about whether there is an envelope in the envelope feeder to the engine control unit 202.

FIG. 13 illustrates a schematic configuration of a conventional direct current voltage application circuit that is usable in a laser beam printer. Hereinafter, a direct voltage will be referred to as a DC bias.

Referring to FIG. 13, a DC bias application circuit 501 includes a voltage setting circuit unit 502, a transformer driving circuit unit 503, a high-voltage transformer 504, and a feedback circuit unit 505. The voltage setting circuit unit 502 can change a setting value according to a pulse width modulation (PWM) signal and set a voltage to be applied to a load. The high-voltage transformer 504 serves as a unit for generating a high voltage. The transformer driving circuit unit 503 is a circuit for driving the high-voltage transformer 504. The feedback circuit unit 505 detects a voltage value applied on a load using a resistance R81, and feeds back the detected voltage value to the voltage setting circuit unit 502 in an analog value. A voltage is controlled to be applied on the load at a constant value based on the fed back analog value. Above-described charging roller 106 is an example of the load. Here, Vcc is a power source voltage.

The above-described circuit configuration enables applying of a constant voltage to a load by controlling the voltage to be applied to a load. Japanese Patent Application Laid-Open No. 6-3932 discusses a technique related to such a circuit configuration. A configuration of a DC bias application circuit discussed in Japanese Patent Application Laid-Open No. 6-3932 can control a voltage value applied to a load to be constant. However, since there is no configuration to detect a current value flowing in the load, the applied voltage cannot be accurately output according to the current flowing in the load.

Moreover, there is a demand to switch control between the above-described constant voltage control which controls a voltage applied to a load to be constant according to a load status (i.e., detected current value), and constant current control which controls a current flowing in a load to be constant. Conventionally, in a case where the control is to be switched between the constant voltage control and the constant current control, a constant voltage control circuit and a constant current control circuit are separately provided (for example, refer to Japanese Patent Application Laid-Open No. 10-32979 and Japanese Patent Application Laid-Open No. 9-179383).

Therefore, conventionally, two control circuits are separately provided for switching the control between the constant voltage control and the constant current control as described above. Therefore, such configuration increases circuit sizes and cost for configuring circuits.

Further, if a plurality of control circuits is provided, switching operation may be required in consideration of each circuit operation status, so that switching between circuits takes time. The longer the time for the switching operation, the more the time to output a target voltage on a load, so that the time for the switching operation increases an entire operation time of the apparatus.

SUMMARY OF THE INVENTION

The present invention is directed to a technique which can switch between a constant voltage control and a constant current control without increasing circuit sizes and costs. Further, the present invention is directed to increasing switching speed between constant voltage control and constant current control operations.

According to an aspect of the present invention, a power source includes a voltage setting unit configured to set an output voltage, a voltage generation unit configured to output the voltage set by the voltage setting unit to a load, a feedback unit configured to detect the voltage output from the voltage generation unit to the load and feed back the detected voltage to the voltage setting unit, a current detection unit configured to detect a current value which is a sum of a current value flowing in the feedback unit and a current value flowing in the load when the voltage set by the voltage setting unit is output to the load, and a control unit configured to switch between a constant current control which controls the voltage set by the voltage setting unit so that the current value detected by the current detection unit becomes a constant current, and a constant voltage control which controls the voltage set by the voltage setting unit so that the voltage output to the load becomes a constant voltage based on the voltage value that is fed back by the feedback unit.

According to another aspect of the present invention, an image forming apparatus includes an image forming unit configured to execute an image formation operation, a voltage setting unit configured to set a voltage to be output to the image forming unit, a voltage generation unit configured to output the voltage set by the voltage setting unit to the image forming unit, a feedback unit configured to detect the voltage output from the voltage generation unit to the image forming unit and feed back the detected voltage to the voltage setting unit, a current detection unit configured to detect a current value which is a sum of a current value flowing in the feedback unit and a current value flowing in the image forming unit when the voltage set by the voltage setting unit is output to the image forming unit, and a control unit configured to switch between a constant current control which controls the voltage set by the voltage setting unit so that the current value to be detected by the current detection unit becomes a constant current, and a constant voltage control which controls the voltage set by the voltage setting unit so that the voltage output to the image forming unit becomes a constant voltage based on the voltage value that is fed back by the feedback unit.

According to yet another aspect of the present invention, a voltage application circuit includes a voltage setting circuit configured to set an output voltage, a transformer configured to output the voltage set by the voltage setting circuit to a load, a feedback circuit configured to detect the voltage output by the transformer to the load and feed back the detected voltage to the voltage setting circuit, a current detection circuit configured to detect a current value which is a sum of a current value flowing in the feedback circuit and a current value flowing in the load when the voltage set by the voltage setting circuit is output to the load, and a control unit configured to switch between a constant current control which controls the voltage to be set in the voltage setting circuit so that the current value detected by the current detection circuit becomes a constant current, and a constant voltage control which controls the voltage set in the voltage setting circuit so that the voltage output to the load becomes a constant voltage based on the voltage value that is fed back by the feedback circuit.

According to another aspect of the present invention, a power source includes a voltage setting unit configured to set an output voltage, a voltage generation unit configured to output the voltage set by the voltage setting unit to a load, a current detection unit configured to detect a current value flowing in the load when the voltage set by the voltage setting unit is output to the load, a feedback unit configured to feed back the current value detected by the current detection unit to the voltage setting unit, a control unit configured to switch between a constant voltage control which controls the voltage set by the voltage setting unit so that the voltage output to the load becomes a constant voltage and a constant current control which controls the voltage set by the voltage setting unit so that the current value that is fed back by the feedback unit becomes a constant current.

According to another aspect of the present invention, an image forming apparatus includes an image forming unit configured to execute an image formation operation, a voltage setting unit configured to set an output voltage to the image forming unit, a voltage generation unit configured to output the voltage set by the voltage setting unit to the image forming unit, a current detection unit configured to detect a current value flowing in the load when the voltage set by the voltage setting unit is output to the image forming unit, a feedback unit configured to feed back the current value detected by the current detection unit to the voltage setting unit, a control unit configured to switch between a constant voltage control which controls the voltage set by the voltage setting unit so that the voltage output to the image forming unit becomes a constant voltage and a constant current control which controls the voltage set by the voltage setting unit so that the current value that is fed back by the feedback unit becomes a constant current.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 12:
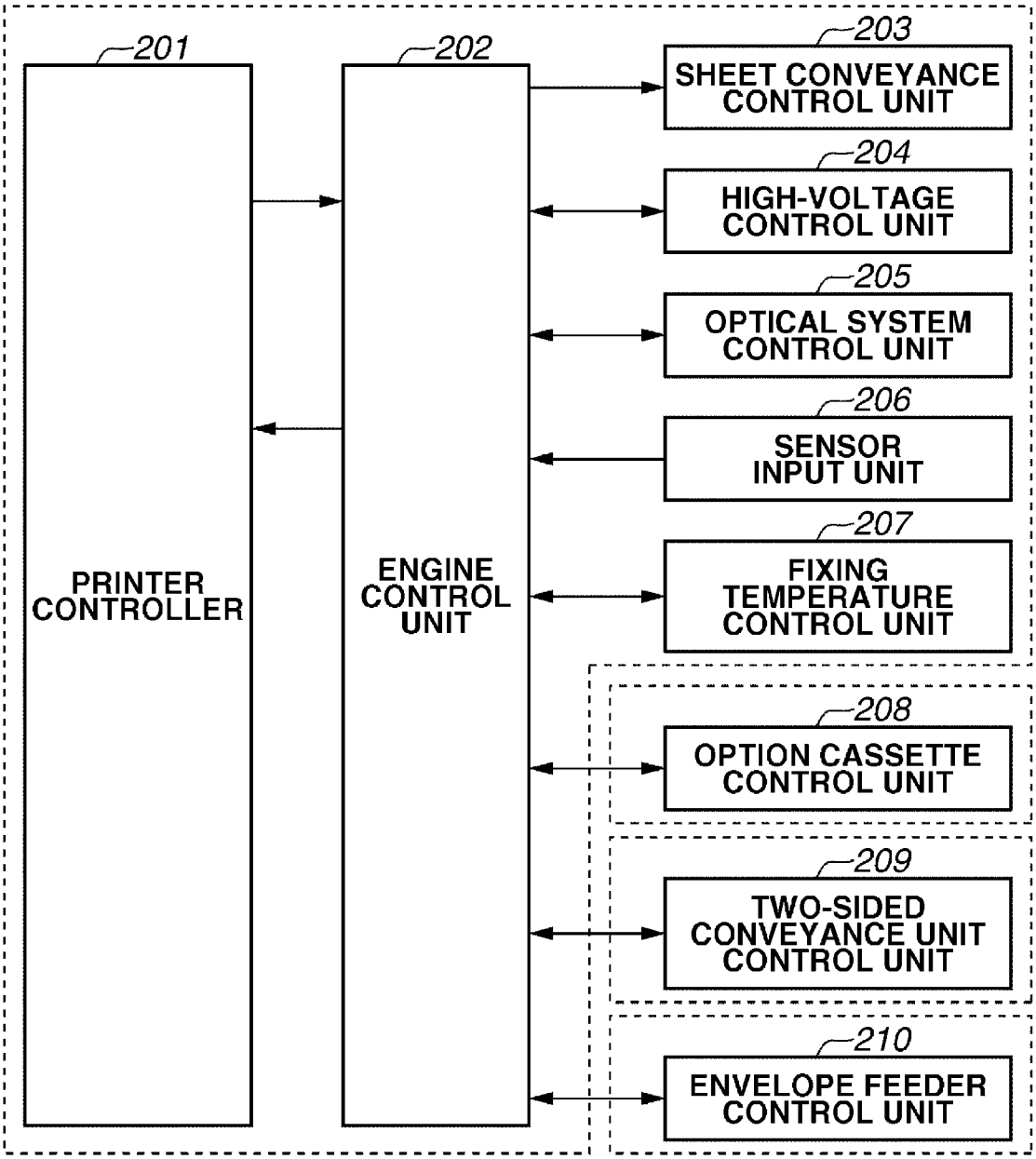
FIG.12 PRIOR ART
FIG. 12 illustrates a configuration of a control unit of a conventional image forming apparatus.
Figure 13:
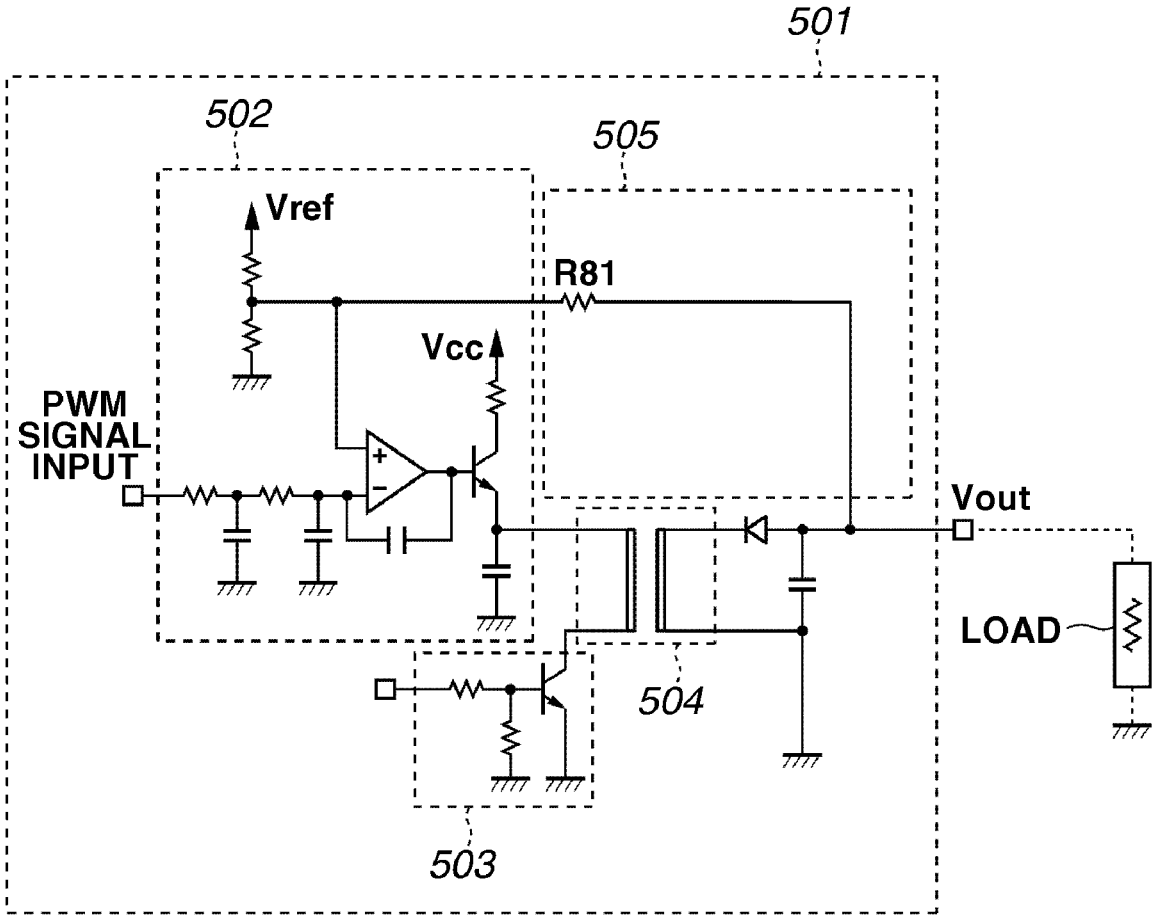
FIG.13 PRIOR ART
FIG. 13 illustrates a configuration of a conventional DC bias application circuit.

In a first exemplary embodiment, an image forming apparatus includes a charging voltage application circuit that applies a voltage on which a voltage of a direct current component is superimposed (hereinafter referred to as a charging bias), to a charging roller, i.e., a charging member. The charging bias of the direct current component is generated by a constant voltage power source. The image forming apparatus includes a current detection circuit that detects a current value flowing in the charging member when the constant voltage source generates the direct current component and outputs the charging bias. Further, the image forming apparatus includes a function for eliminating a remaining potential on a photosensitive drum, i.e., an image carrier which is charged by a charging member, by irradiating the drum with light in an exposure unit using a light-emitting element. A configuration of a circuit which controls an operation of the image forming apparatus according to the present invention is similar to that of FIG. 12 described above, and further description will be omitted.

In the present exemplary embodiment, the exposure unit using the light-emitting element irradiates with light a non-image forming region (i.e., a region that corresponds to a period in which an image formation is not performed) of the photosensitive drum and eliminates a remaining potential on the photosensitive drum. The charging bias application circuit then applies a predetermined voltage to a charging roller which is a charging member. At that time, the current detection circuit detects a value of a current flowing in the charging roller. When the detected current value becomes a desired value, the current detection circuit detects an output voltage of the constant voltage power source. Consequently, the charging bias application circuit can control a potential on the photosensitive drum to be constant based on the detected voltage. Hereinafter, a power source for outputting high voltage to perform the above-described control will be referred to as a high-voltage power source.

Figure 1:
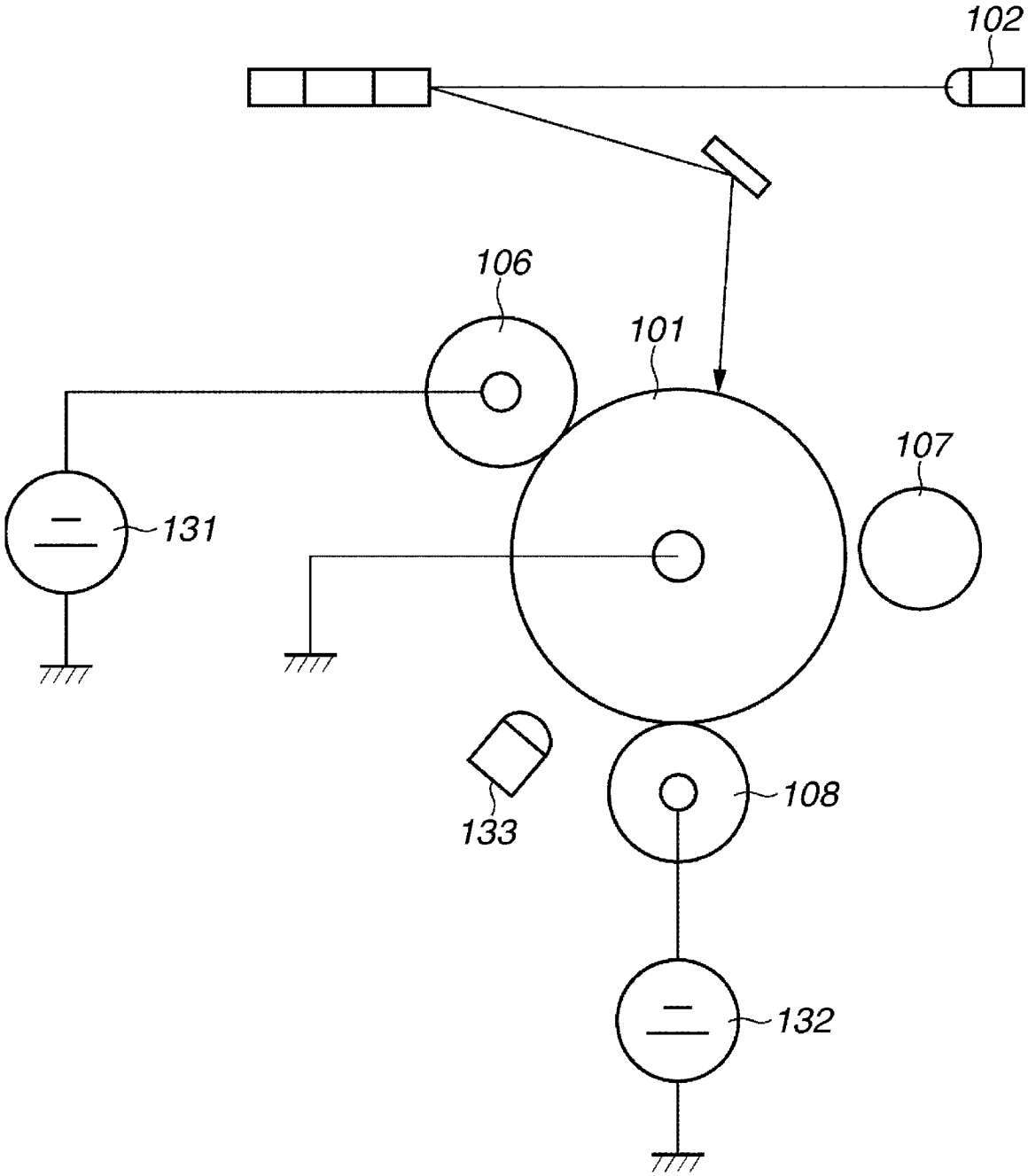
FIG. 1 illustrates an example configuration of an image forming unit of an image forming apparatus according to a first exemplary embodiment of the present invention.
Figure 11:
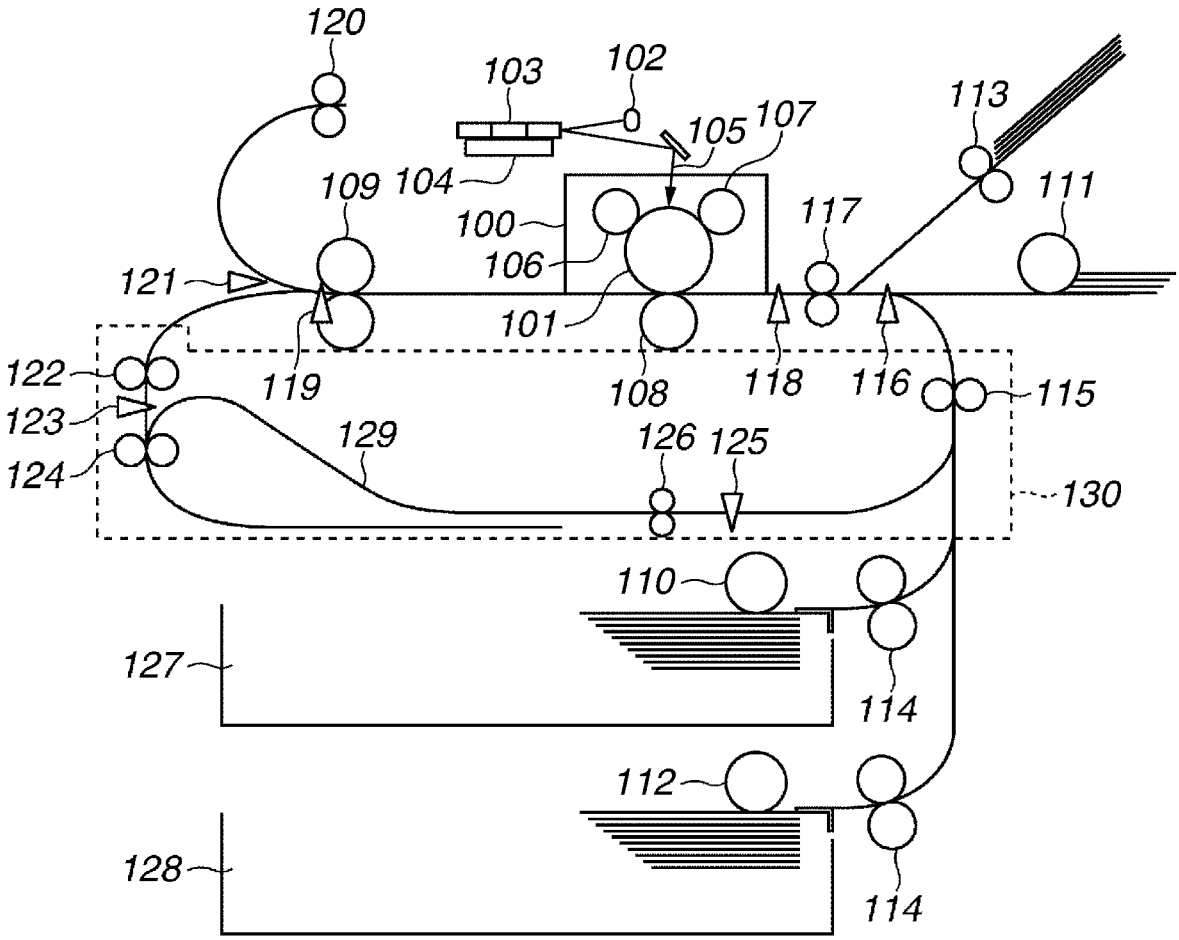
FIG.11 PRIOR ART
FIG. 11 illustrates a configuration of a conventional image forming apparatus

FIG. 1 illustrates a configuration of an image forming unit of the image forming apparatus according to the first exemplary embodiment. A configuration similar to that in FIG. 11 described above will be described using the same reference numerals.

Referring to FIG. 1, the image forming unit includes a photosensitive drum 101 as an image carrier, and a charging roller 106 which is a charging member for charging the photosensitive drum 101. A developing roller (or a developing sleeve) 107 conveys a toner, i.e., a developer, to the photosensitive drum 101. A transfer roller 108 is a transfer member which transfers a toner image formed on the photosensitive drum 101 to a sheet. A pre-exposure light source 133 is an exposure unit which eliminates the remaining potential on the photosensitive drum 101. A charging bias application circuit 131 is a voltage application circuit for applying a charging bias to the charging roller 106. A transfer bias application circuit 132 is a voltage application circuit for applying the bias to the transfer roller 108. A laser light source 102 is used in forming a latent image on the photosensitive drum 101.

Figure 2:
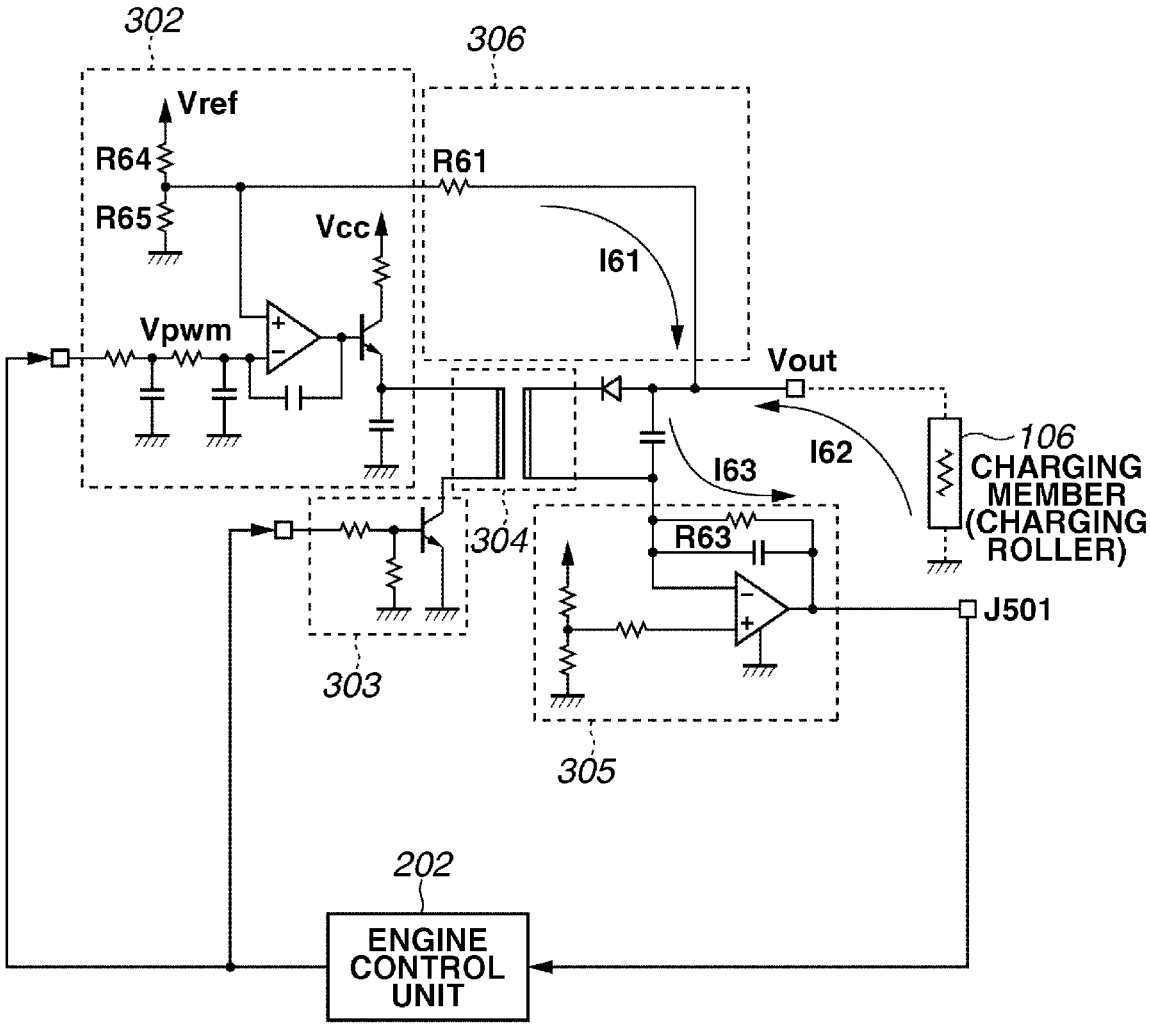
FIG. 2 illustrates an example configuration of a charging voltage application circuit according to the first exemplary embodiment of the present invention.

FIG. 2 illustrates a configuration of the charging bias application circuit 131 according to the first exemplary embodiment of the present invention.

Referring to FIG. 2, a voltage setting circuit unit 302 sets an output voltage according to a PWM signal set by the engine control unit 202 via an input terminal. A high-voltage transformer 304 generates a high voltage. A transformer driving circuit unit 303 drives the high-voltage transformer 304 (i.e., a voltage generation unit) when a driving signal is input from the engine control unit 202. A feedback circuit unit 306 monitors an output voltage via a resistance R61 and feeds back the monitored voltage to the voltage setting circuit unit 302 so as to obtain an output voltage value corresponding to the setting value of the PWM signal. A current detection circuit unit 305 detects a current I63 which is a sum of a current I62 flowing in the charging roller 106 and a current I61 flowing in the feedback circuit unit 306, by a resistance R63. The detected current value is transmitted to the engine control unit 202 from an output terminal J501 in an analog value. Here, Vcc is a power source voltage.

Before discharge starts between the photosensitive drum 101 and the charging roller 106 illustrated in FIG. 1, the photosensitive drum 101 and the charging roller 106 are insulated from each other. Consequently, only the current I61 from the feedback circuit unit 306 flows in the resistance R63 which is used for detection, before the discharge starts. The value of the current I61 is determined by a following equation, based on a voltage value Vpwm set by the input PWM signal, a reference voltage value Vref, and resistances R64 and R65.

$$I61=(Vref-Vpwm)/R64-Vpwm/R65$$

Further, when the current I61 is flowing in the feedback resistance R61, an output voltage Vout is set as a following equation.

$$Vout=I61\times R61+Vpwm\approx I61\times R61$$

Figure 3:
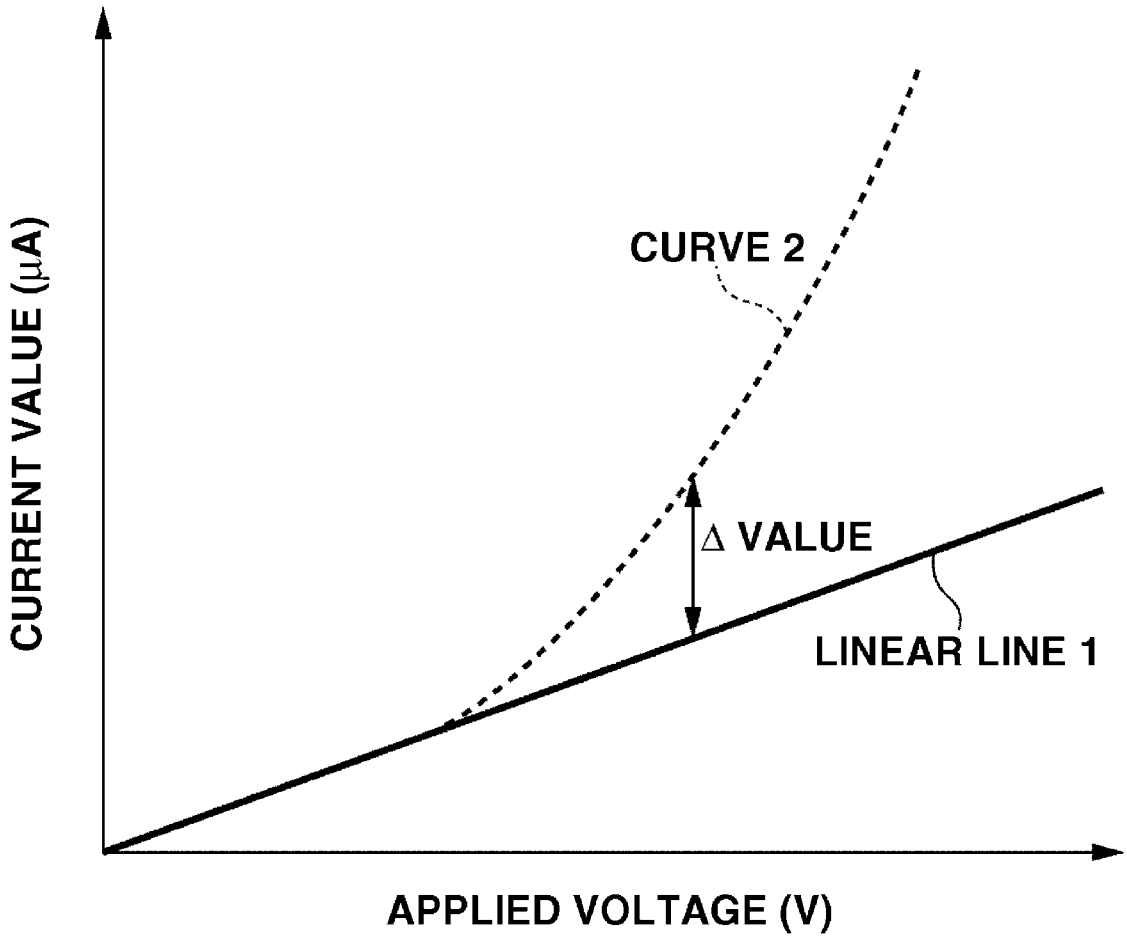
FIG. 3 is a graph illustrating a relation between an applied voltage and a current value when a charging bias is applied according to the first exemplary embodiment of the present invention.

Referring to FIG. 3, a linear line 1 represents the above-described state in which only the current I61 according to the PWM signal is flowing in the resistance R63 before the discharge starts.

However, when the discharge starts between the photosensitive drum 101 and the charging roller 106, the current I63 which is a sum of the current I62 flowing in the charging roller 106 and the current I61 flowing from the feedback circuit unit 306 flows in the resistance R63. Referring to FIG. 3, a relation between the current value and the applied voltage is illustrated with a curve 2 which branches from the linear line at a point when the discharge starts.

Figure 4:
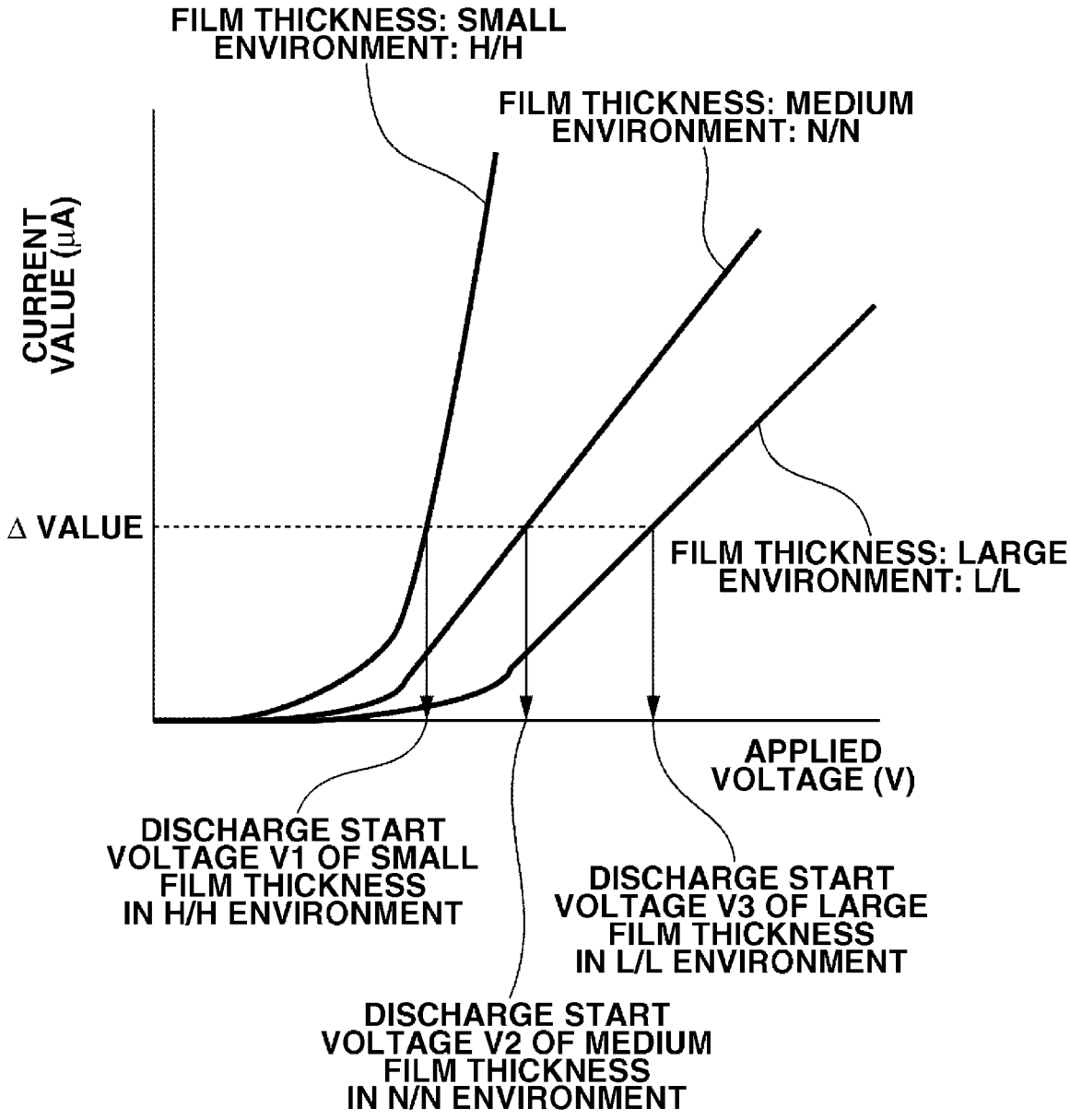
FIG. 4 is a graph illustrating a relation between an applied voltage and a current value between a photosensitive drum and a charging roller according to the first exemplary embodiment of the present invention.

A current flowing in the charging roller 106 can be calculated by a Δ value which is a difference between the curve 2 and the linear line 1. A voltage at which the Δ value becomes a predetermined current value is determined as a discharge start voltage. Referring to FIG. 4, the Δ value used to determine a discharge start is a value at which a stable discharge current value can be detected in consideration of a characteristic (a relation between the current value and the applied voltage) according to a film thickness of the photosensitive drum 101 and environment. In FIG. 4, an environment H/H means a high temperature and high humidity environment, an environment N/N means a normal temperature and normal humidity environment, and an environment L/L means a low temperature and low humidity environment. FIG. 4 illustrates that discharge start voltages V1, V2 and V3 for obtaining the Δ value vary according to each environment and a film thickness of the photosensitive drum.

Figure 5:
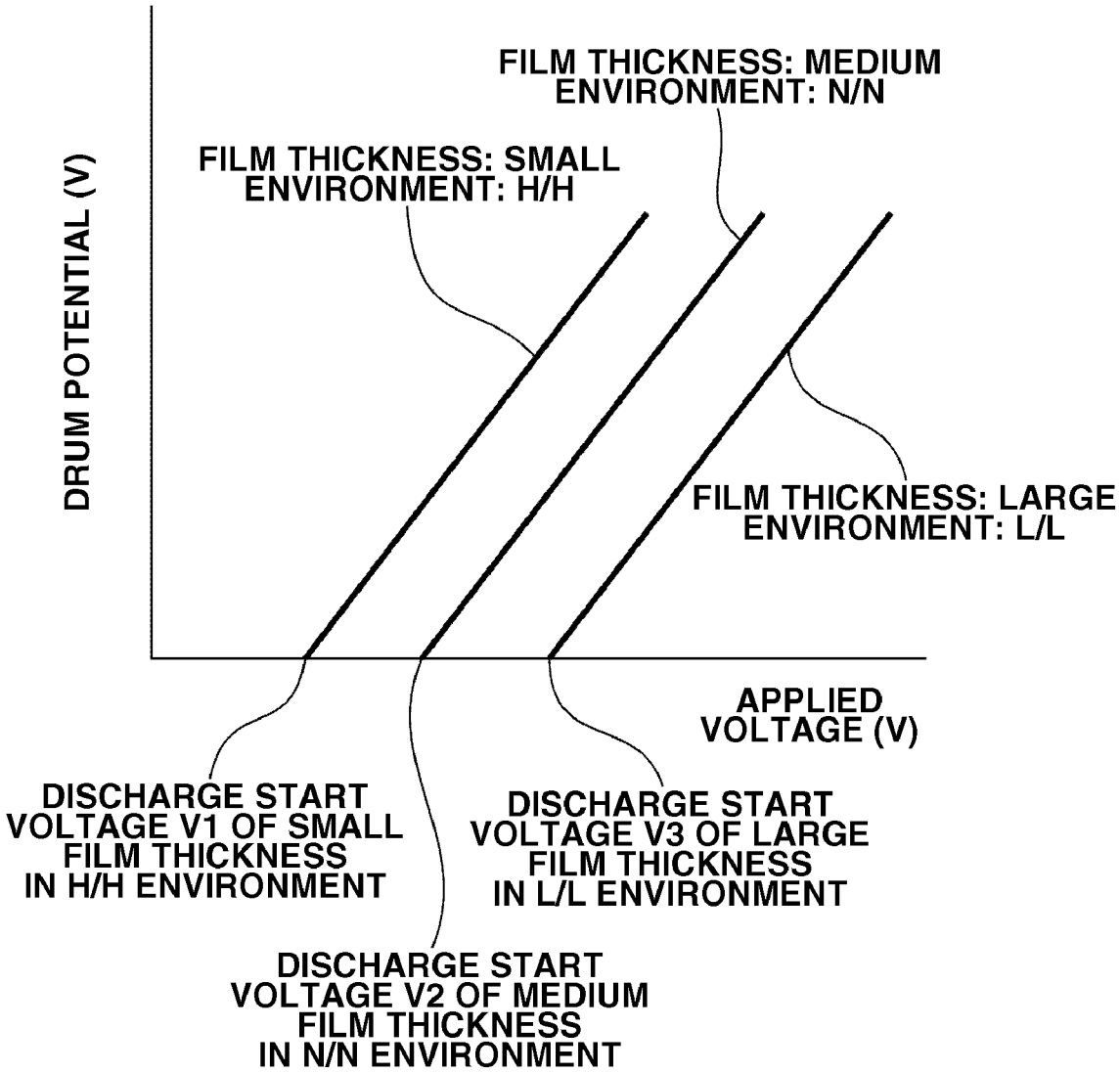
FIG. 5 is a graph illustrating a characteristic of a discharge start voltage between a photosensitive drum and a charging roller according to the first exemplary embodiment of the present invention.
Figure 6:
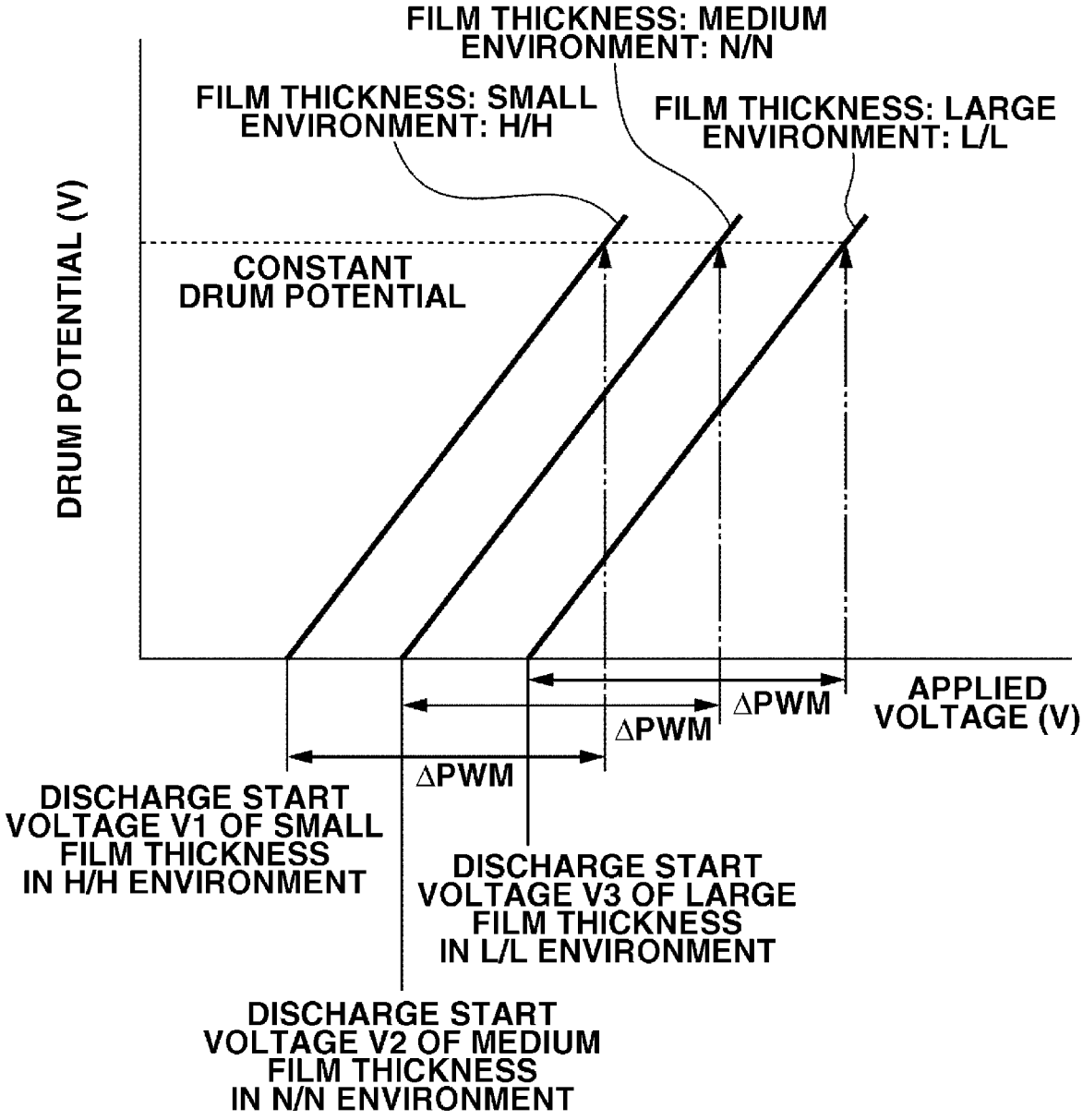
FIG. 6 is a graph illustrating a voltage value to be added to a discharge start voltage between a photosensitive drum and a charging roller according to the first exemplary embodiment of the present invention.

Further, characteristics of the photosensitive drum 101 and the charging roller 106 are set so that a relation between an applied voltage and a potential on the photosensitive drum 101 becomes linear (i.e., correlated) as illustrated in FIG. 5. When the discharge start voltage is detected, a predetermined voltage value (a ΔPWM value) is added to the voltage, as illustrated in FIG. 6. Referring to FIG. 6, the ΔPWM value to be added is appropriately set for each of the discharge start voltage values V1, V2 and V3 according to a film thickness of the photosensitive drum 101 and environment, so that the potential of the photosensitive drum 101 becomes constant. When the above-described configuration is provided, the potential of the photosensitive drum 101 can be maintained substantially constant by setting a voltage to be applied to the charging roller 106, even in a case where a film thickness of the photosensitive drum 101 and an environmental characteristic are changed.

It is noted that combinations of the environments and the film thicknesses are described in the present exemplary embodiment only as examples. In a case of a different combination, an appropriate discharge start voltage for that combination can be differently set. Further, in a case where an image density is changed, a ΔPWM value to be added is changed.

Further, in FIGS. 5 and 6, the environment H/H means a high temperature and high humidity environment, the environment N/N means a normal temperature and normal humidity environment, and the environment L/L means a low temperature and low humidity environment. The present exemplary embodiment sets conditions for the environment H/H as 32.5° C./80%, the environment N/N as 23.0° C./50%, and the environment L/L as 15° C./10%.

Figure 7:
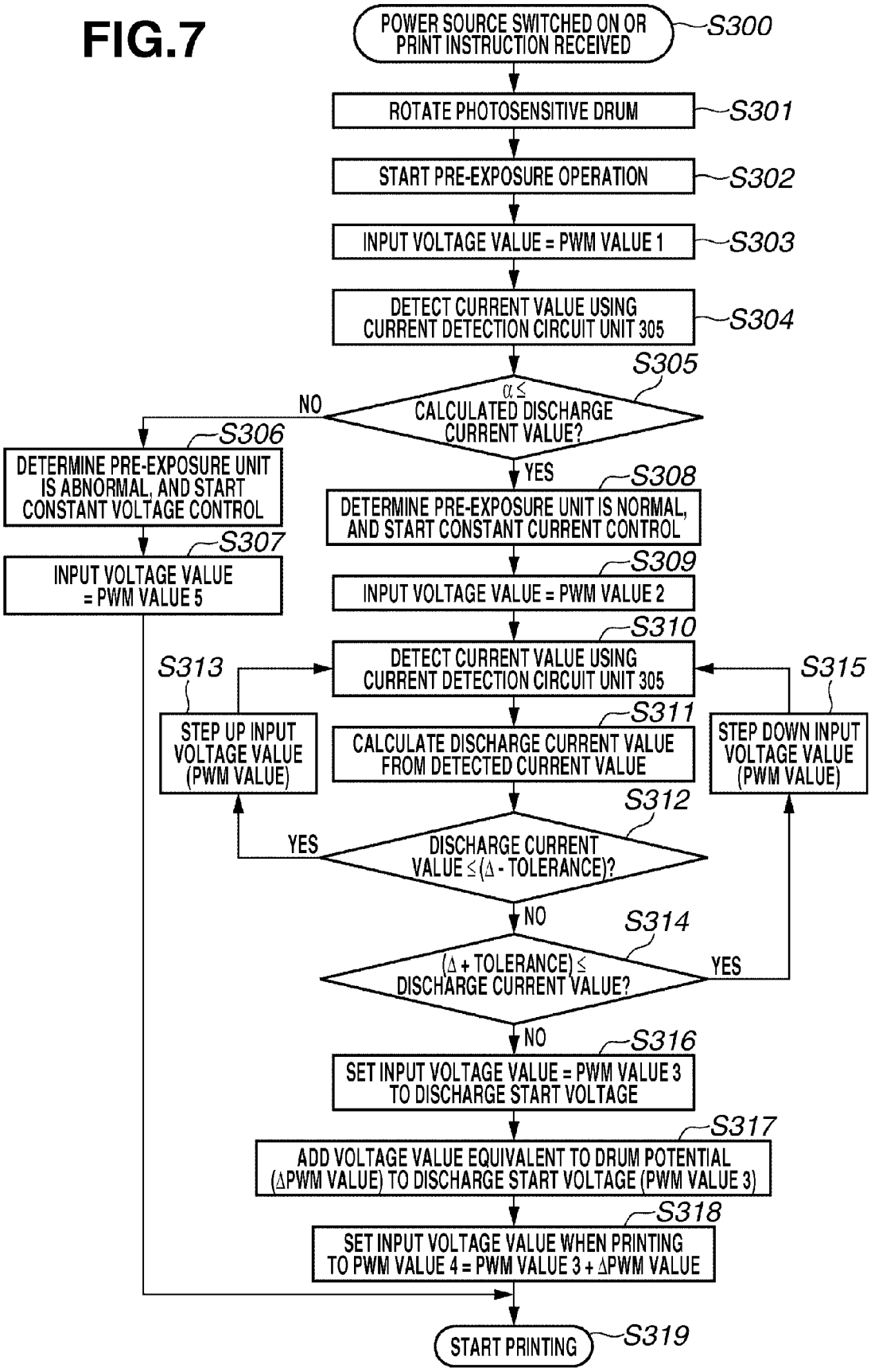
FIG. 7 is a flowchart illustrating an operation of a charging voltage application circuit according to the first exemplary embodiment of the present invention.

Operations of the present exemplary embodiment will be described with reference to a flowchart illustrated in FIG. 7. The operations illustrated in FIG. 7 are controlled by the engine control unit 202 (illustrated in FIG. 2) of the image forming apparatus.

In step S300, when a power source of the image forming apparatus is switched on or a print instruction is received by the image forming apparatus, the engine control unit 202 starts an initializing operation of the image forming apparatus and performs a pre-rotation operation of the photosensitive drum 101.

In step S301, the engine control unit 202 rotates the photosensitive drum 101.

In step S302, the engine control unit 202 starts a pre-exposure of the photosensitive drum 101 on a non-image forming region while performing the initializing operation. The non-image forming region of the photosensitive drum 101 is a region that corresponds to a period in which an image formation is not performed. In a pre-exposure operation, the engine control unit 202 drives the light source 133, i.e., a pre-exposure unit, by a predetermined driving signal to emit light and expose a surface of the photosensitive drum 101 therewith. The pre-exposure operation is performed to uniform a surface potential of the photosensitive drum 101 and eliminate potential unevenness.

In step S303, the engine control unit 202 inputs a PWM value 1 as a predetermined input voltage value in the voltage setting circuit unit 302 to apply a voltage. The PWM value 1 is previously set to apply a voltage value near the above-described discharge start voltage value (e.g., a value of approximately −600V).

In step S304, after applying the voltage, the engine control unit 202 detects the current I63 which is a sum of the current I62 flowing from the charging roller 106 and the current I61 flowing from the feedback circuit 306 by the current detection unit 305. The current I63 is detected from the output terminal J501 in an analog value.

In step S305, the engine control unit 202 calculates a discharge current value as illustrated in FIG. 3 based on the detected analog value. The engine control unit 202 compares the calculated value and an α value to determine whether the calculated discharge current value is larger than or equal to the α value. The α value is a threshold value for detecting a failure of the pre-exposure unit (i.e., the light source 133 illustrated in FIG. 1). If the calculated value is smaller than the α value (NO in step S305), the process proceeds to step S306.

In step S306, the engine control unit 202 determines that there may be a failure in the pre-exposure unit and performs a constant voltage control. In step S307, the engine control unit 202 applies a PWM value 5 (e.g., a preset value such as −1000V) as a predetermined input voltage if there is the failure in the pre-exposure unit. That is, in a case where the engine control unit 202 fixes a PWM value and applies a voltage, the constant voltage control is performed to output the voltage corresponding to the setting value of a PWM signal. The engine control unit 202 monitors an output voltage via the resistance R61, and feeds back the monitored voltage to the voltage setting circuit unit 302.

In step S319, the engine control unit 202 outputs a charging bias in the above-described setting and performs a print operation. In a case where the engine control unit 202 determines that there is the failure in the pre-exposure unit, a signal indicating that a control unit of the image forming apparatus fails can be output on a display unit (not illustrated) or to an external device such as a host computer (not illustrated).

On the other hand, if the calculated value is larger than or equal to the α value (YES in step S305), the process proceeds to step S308. In step S308, the engine control unit 202 determines that the pre-exposure unit is normal and starts performing operations for a constant current control.

In step S309, the engine control unit 202 applies a PWM value 2 as a predetermined voltage value to the voltage setting circuit unit 302. The PWM value 2 is a voltage value near the above-described discharge start voltage and smaller than the discharge start voltage.

In step S310, the engine control unit 202 detects the current I63 which is a sum of the current I62 flowing from the charging roller 106 and the current I61 flowing from the feedback circuit 306 by the current detection circuit unit 305 in an analog value output from the output terminal J501. In step S311, the engine control unit 202 calculates a discharge current value from the detected current value.

In steps S312 and S314, the engine control unit 202 compares the calculated discharge current value and the above-described Δ value to determine whether the calculated discharge current value is within a tolerance of the Δ value. In a case where the calculated value is smaller than or equal to (Δ−tolerance value) (YES in step S312), the process proceeds to step S313.

In step S313, the engine control unit 202 determines that the discharge start voltage is to be set higher, and an input voltage (i.e., PWM value) is stepped up. In a step up process, the PWM value is increased by a predetermined value, i.e., a pulse width value to be set is increased.

On the other hand, in a case where the calculated value is larger than (Δ−tolerance value) (NO in step S312), and larger than or equal to (Δ+tolerance value) (YES in step S314), the process proceeds to step S315. Instep S315, the engine control unit 202 determines that the discharge start voltage is to be set lower, and the input voltage value (i.e., PWM value) is stepped down. In a step down process, the PWM value is decreased by a predetermined value, i.e., a pulse width value to be set is decreased. These processes are repeated, and when the calculated discharge current value becomes within the tolerance of the Δ value (NO in step S314), the process proceeds to step S316.

In step S316, the engine control unit 202 sets the PWM value 3 which is the input voltage at the time as a discharge start voltage. In step S317, the engine control unit 202 adds a ΔPWM value (as illustrated in FIG. 6) to the PWM value 3 determined as the discharge start voltage. The ΔPWM value is an input voltage value that corresponds to a potential when charging the photosensitive drum 101. In step S318, the engine control unit 202 sets a PWM value 4 (i.e., PWM value 3+ΔPWM value) to the voltage setting circuit unit 302 as an input voltage value when printing is performed. In step S319, the print operation is started after the above-described settings are completed.

In the present exemplary embodiment, a tolerance value is set at ±0.5 μA. This value can be changed as necessary according to a circuit configuration (e.g., a characteristic of a circuit element to be used).

As described above, according to the first exemplary embodiment, an apparatus can be configured such that the constant voltage control and the constant current control can be switched without increasing a circuit size and cost.

Further, since the constant voltage control and a constant current control can be continuously switched, potential unevenness on the photosensitive drum 101 can be decreased. Further, a potential status of the surface of the photosensitive drum 101 becomes approximately constant regardless of the film thickness of the photosensitive drum 101 and the environmental status. Consequently, charging unevenness of the photosensitive drum 101 is reduced, and a high-quality image can be formed.

Furthermore, since the constant voltage control and the constant current control can be continuously switched and the potential unevenness on the photosensitive drum 101 is decreased, an image quality such as gray-scale image can be improved.

According to the first exemplary embodiment, switching between the constant voltage control and the constant current control can be performed at a higher speed.

Further, according to the first exemplary embodiment, the current flowing in the load can be accurately calculated, and a stable constant current control can be performed.

Second Exemplary Embodiment

In a second exemplary embodiment, an image forming apparatus includes a transfer voltage application circuit that applies a voltage on which a voltage of a direct current component is superimposed (hereinafter referred to as a transfer bias) to the transfer roller 108 (i.e., a transfer member) as illustrated in FIG. 1. The image forming apparatus includes a detection circuit that detects a current value flowing in the transfer roller 108 when a constant voltage power source generates the direct current component and outputs the transfer bias. A configuration of an image forming unit of the image forming apparatus is similar to that in the first exemplary embodiment, and description is omitted.

In the present exemplary embodiment, during a non-image forming period in which an image is not being formed, the transfer bias application circuit applies a predetermined voltage to the transfer roller 108 and gradually increases the applied voltage. At that time, the detection circuit detects a current value flowing in the transfer roller 108. When a detected current value reaches a desired value, an output voltage of the constant voltage power source is detected. A resistance value of the transfer roller 108 is calculated from the detected output voltage and the current value. A selection is made between the constant current control and the constant voltage control based on the calculated resistance value to perform control that a suitable voltage is applied on the transfer roller 108.

The present exemplary embodiment describes a high-voltage power source which is necessary for performing the above-described control.

Figure 8:
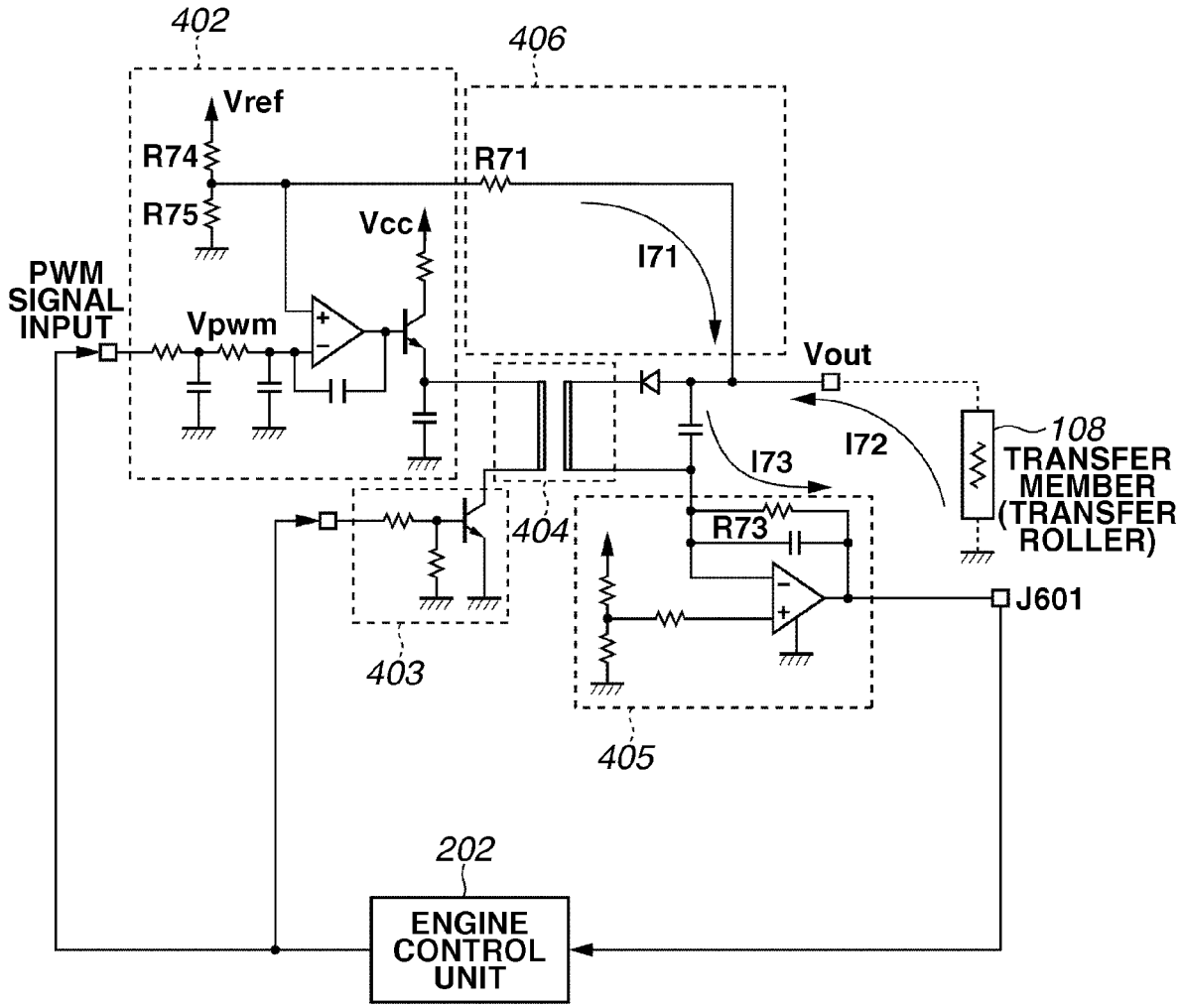
FIG. 8 illustrates a configuration of a transfer voltage application circuit according to a second exemplary embodiment of the present invention.

FIG. 8 illustrates a configuration of a transfer bias application circuit according to the present exemplary embodiment. The circuit configuration illustrated in FIG. 8 is similar to the configuration described in the first exemplary embodiment. However, resistance values, condenser capacities, and PWM values are changed as necessary according to a voltage supplied to a load.

Referring to FIG. 8, a voltage setting circuit unit 402 can variably set a high-voltage output according to a PWM signal input from the engine control unit 202. A high-voltage transformer 404, i.e., a voltage generation unit, generates a high voltage. A transformer driving circuit 403 which drives the high-voltage transformer 404 is driven by a drive signal from the engine control unit 202. A feedback circuit unit 406 detects an output voltage via a resistance R71 and feeds back the detected voltage to the voltage setting circuit unit 402, so that the output voltage value can correspond to a set PWM signal. A current detection circuit unit 405 detects a current I73 by a detection resistance R73. The current I73 is a sum of a current I72 flowing in the transfer roller 108 and a current I71 flowing from the feedback circuit 406. The value of the current I73 is transmitted from a terminal J601 to the engine control unit 202 in an analog value. Here, Vcc is the power source voltage.

The transfer roller 108 is formed by a resistance component. Consequently, the current flowing in the detection resistance R73 when a voltage is applied is a sum of the current I71 flowing from the feedback circuit unit 406 and the current I72. The value of the current I71 can be obtained by a following equation, using the voltage value Vpwm set by the PWM signal, the reference voltage value Vref, and resistances R74 and R75.

$$I71=(Vref-Vpwm)/R74-Vpwm/R75.$$

The output voltage Vout is set when the current I71 flows through the feedback resistance R71. That is, the voltage Vout applied to the transfer roller 108 is set by a following equation:

$$Vout=I71\times R71+Vpwm\approx I71\times R71$$

Figure 9:
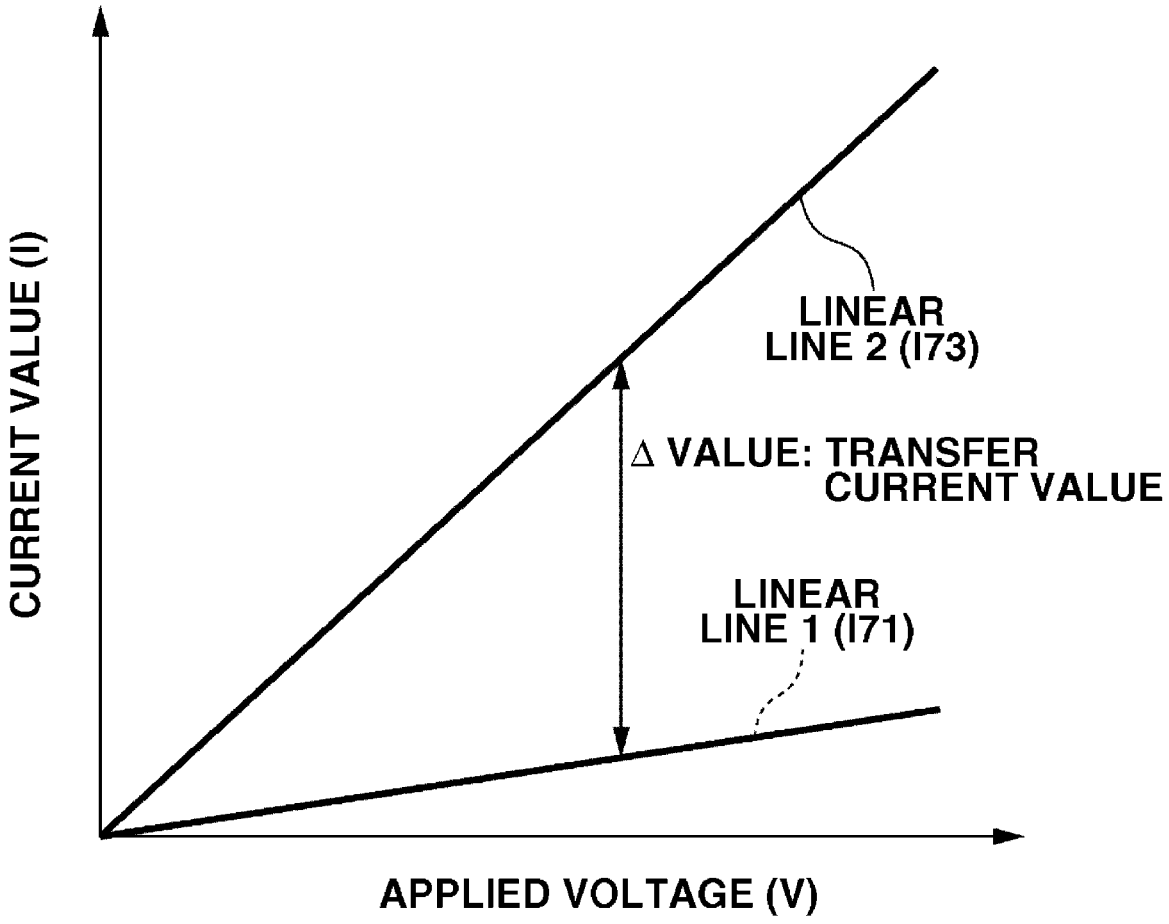
FIG. 9 is a graph illustrating a relation between an applied voltage and a current value in a transfer operation according to the second exemplary embodiment of the present invention.

The current flowing in the transfer roller 108 is a value of the current I72 which is a difference between the detected current I73 and the current I71 flowing in the feedback circuit unit 406. Consequently, the current flowing in the transfer roller 108 can be calculated as a Δ value which is a difference between a linear line 2 (I73) and a linear line 1 (I71) illustrated in FIG. 9.

A resistance value of the transfer roller 108 is calculated based on an output voltage when the Δ value reaches a desired current value. The following high-voltage application method is optimized according to the calculated resistance.

Figure 10:
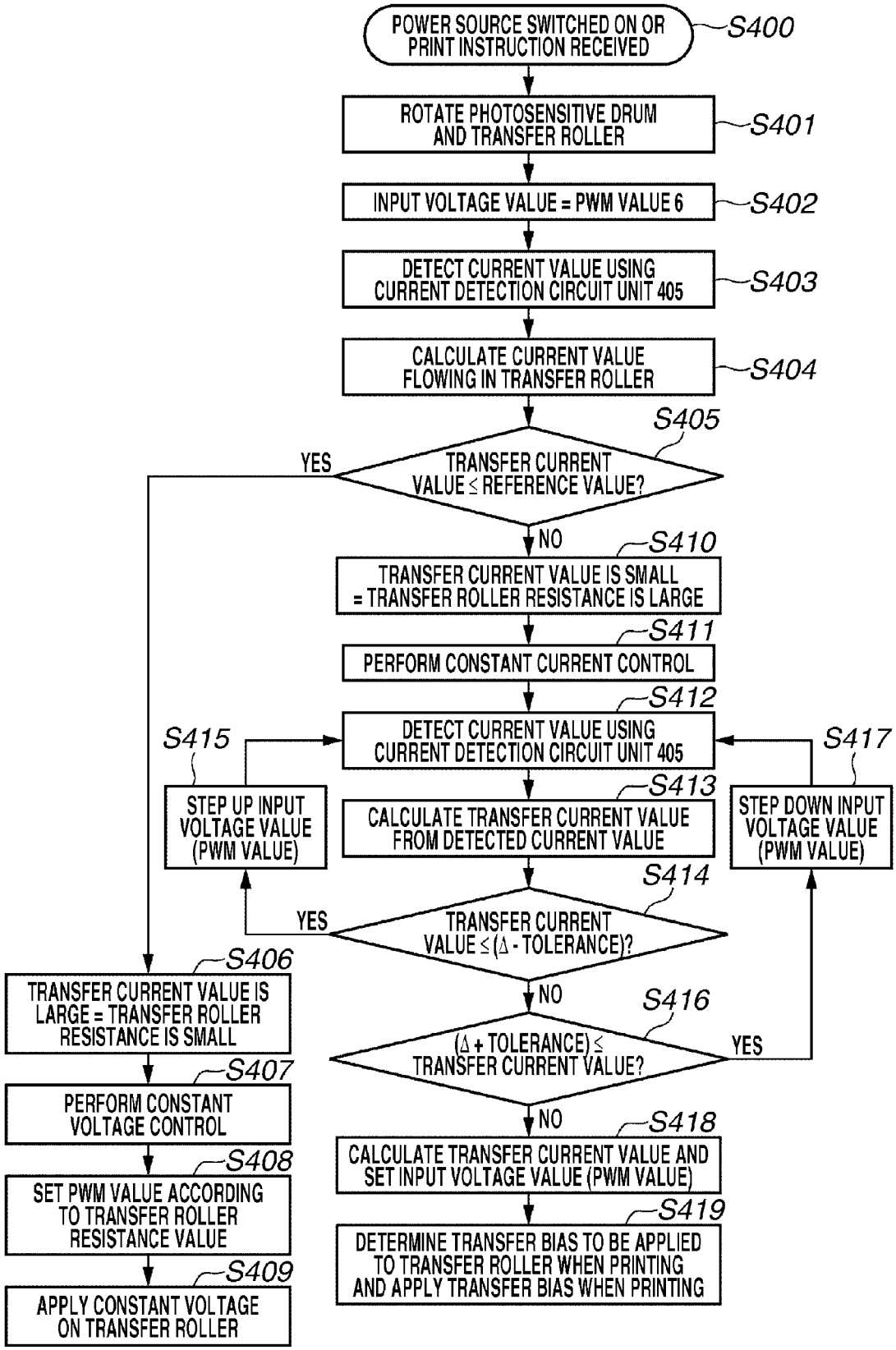
FIG. 10 is a flowchart illustrating an operation of a transfer voltage application circuit according to the second exemplary embodiment of the present invention.

Operations of the above-described transfer bias application circuit will be described with reference to a flowchart illustrated in FIG. 10. The operations of the flowchart illustrated in FIG. 10 are controlled by the engine control unit 202 (illustrated in FIG. 8) of the image forming apparatus.

In step S400, a power source is switched on or a print instruction is received. In step S401, the engine control unit 202 rotates the photosensitive drum 101 and the transfer roller 108 in an initializing operation. The engine control unit 202 performs the initializing operation to stabilize in particular a surface potential of the photosensitive drum 101. The engine control unit 202 rotates the transfer roller 108 in synchronization with the photosensitive drum 101.

In step S402, the engine control unit 202 applies a PWM value 1 as a predetermined input voltage during a non-image forming period (i.e., an operation period when an image formation is not performed) while the transfer roller 108 is being rotated in the initializing operation. The PWM value 1 is a preset value and is different from the value described in the first exemplary embodiment. In the present exemplary embodiment, the PWM value 1 is determined according to a target voltage value to be applied to the transfer roller 108.

In step S403, the engine control unit 202 detects the current I73 by the output terminal J601 in an analog value. The current I73 is a sum of the current I72 flowing from the transfer roller 108 and the current I71 flowing from the feedback circuit unit 406 In step S404, the engine control unit 202 calculates a transfer current value flowing in the transfer roller 108 as described above, based on the detected value.

In step S405, the engine control unit 202 compares the calculated transfer current value and a preset reference value and determines whether the calculated transfer current value is smaller than or equal to the reference value.

If the calculated current value is smaller than or equal to the reference value (YES in step S405), the process proceeds to step S406. In step S406, the engine control unit 202 determines that since the transfer current is large, the resistance value of the transfer roller 108 is low. In step S407, the engine control unit 202 makes a setting to perform the constant voltage control. In step S408, the engine control unit 202 performs the constant voltage control by setting the PWM value to apply a constant voltage appropriate for the resistance value of the transfer roller 108. In step S409, the engine control unit 202 applies a high voltage so that the voltage of the transfer roller 108 becomes approximately constant. That is, the constant voltage control is performed to control the output voltage value to correspond to a setting value of the PWM signal by the engine control unit 202. The engine control unit 202 fixes the PWM value and applies the voltage to the transfer roller 108, monitors the output voltage via the resistance R71, and feeds back the monitored voltage to the voltage setting circuit unit 402.

On the other hand, if the calculated current value is larger than the reference value (NO in step S405), the process proceeds to step S410. In step S410, the engine control unit 202 determines that since the transfer current is small, the resistance value of the transfer roller 108 is large. In step S411, the engine control unit 202 makes a setting to perform the constant current control and starts control to obtain a desired transfer current value. In step S412, the engine control unit 202 gradually changes a value of the voltage value Vpwm set by the PWM signal and detects the current value at the current detection circuit unit 405. The engine control unit 202 thus sets the PWM value to obtain the desired transfer current value. In step S413, the engine control unit 202 calculates the transfer current value from the detected current value.

In steps S414 and S416, the engine control unit 202 compares the calculated transfer current value and the above-described Δ value to determine whether the calculated transfer current value is within a tolerance of the Δ value. In step S414, the engine control unit 202 determines whether the calculated transfer current value is smaller than or equal to Δ−tolerance. If the transfer current value is smaller than or equal to Δ−tolerance (YES in step S414), the process proceeds to step S415. In step S415, the engine control unit 202 determines that the transfer current value is small and steps up the PWM value to increase the input voltage value.

On the other hand, if the transfer current value is larger than Δ−tolerance (NO in step S414), the process proceeds to step S416. In step S416, the engine control unit 202 determines whether the calculated transfer current value is larger than or equal to Δ+tolerance. If the engine control unit 202 determines that the calculated transfer current value is larger than or equal to Δ+tolerance and the transfer current value is large (YES in step S416), the process proceeds to step S417. In step S417, the engine control unit 202 steps down the PWM value to decrease the input voltage value. The PWM value is increased or decreased by a predetermined value in the step up or step down process.

If the engine control unit 202 determines that the calculated transfer current value is larger than or equal to Δ+tolerance (NO in step S416), the engine control unit 202 determines that the calculated transfer current value is within the tolerance of the Δ value and an optimum transfer current value is obtained. The process then proceeds to step S418. In step S418, the engine control unit 202 sets the PWM value. In step S419, the engine control unit 202 determines the transfer bias that is to be applied in printing and applies the determined transfer bias to the transfer roller 108 when printing is performed.

When printing is continuously performed (such as continuously printing 100 copies), the resistance value of the transfer roller 108 may change. In such a case, it is more effective to detect the transfer current value during the non-image forming period and to perform control to correct the transfer bias based on the detected current value even when continuous printing is being performed. The non-image forming period is when the transfer roller 108 is not transferring an image (i.e., a period when no sheet is present in a nip portion formed between the transfer roller 108 and the photosensitive drum 101, that is also referred to as sheets interval).

As described above, according to the second exemplary embodiment, when the transfer roller 108 is provided as a voltage application target, the constant voltage control and the constant current control can be switched without increasing a circuit size and cost.

As described above, according to the second exemplary embodiment, an optimum transfer bias can be applied regardless of variations in the transfer roller 108 or temperature change. As a result, a high-quality image can be formed.

Further, similar to the first exemplary embodiment, switching between the constant voltage control and the constant current control of the circuit can be performed at a higher speed.

Further, according to the second exemplary embodiment, the current flowing in the load can be accurately calculated, and a stable constant current control can be performed.

Other Exemplary Embodiments

In the first exemplary embodiment, when the pre-exposure unit is determined as abnormal based on the calculated discharge current value in the constant current control, the engine control unit 202 switches to the constant voltage control. In the second exemplary embodiment, the resistance value of the transfer roller 108 is determined based on the calculated current value in the constant current control, and the engine control unit 202 switches to the constant voltage control. However, the present invention is not limited to such embodiment, and the engine control unit 202 can switch between the constant current control and the constant voltage control based on a load to which the voltage is applied.

Further, in the first exemplary embodiment, the output voltage Vout is detected at an input unit of the voltage setting circuit unit 302 and stabilized by feeding back the detected value via the feedback circuit unit 306 in FIG. 2. However, the output can be controlled at the constant current by feeding back the detected current value, namely the output, of the current detection circuit unit 305 to the input unit of the voltage setting circuit unit 302 instead of feeding back the output voltage Vout. The detected value of the output voltage Vout can be further divided by the resistance R61 and fed back to an A/D conversion input unit (not illustrated) of the engine control unit 202 to stabilize the output voltage. According to the above described configuration, switching between the constant voltage control and the constant current control of the circuit can be performed similarly to the first exemplary embodiment, and an effect similar to that of the first exemplary embodiment can be obtained.

When the constant voltage control is performed by feedback operation of hardware and the constant current control is performed via the CPU in the engine control unit 202, the feedback operation can be performed at a higher speed. More specifically, when a voltage variation affects an image more than a current variation in the image forming apparatus, the constant voltage control can be performed by the above described feedback operation of the hardware. On the other hand, when the current variation affects the image more than the voltage variation, the constant current control can be performed by the feedback operation via the CPU.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-216125 filed Aug. 22, 2007, which is hereby incorporated by reference herein in its entirety.

What is claimed is:

1. A power source for applying a voltage on an image forming unit of an image forming apparatus, the power source comprising:

a voltage setting unit configured to set an output voltage;

a voltage generation unit configured to output the voltage set by the voltage setting unit to a load;

a feedback unit configured to detect the voltage output from the voltage generation unit to the load and feed back the detected voltage to the voltage setting unit;

a current detection unit configured to detect a current value flowing in the load when the voltage set by the voltage setting unit is output to the load; and a control unit configured to switch between a constant current control operation and a constant voltage control operation, wherein the constant current control operation controls the voltage set by the voltage setting unit so that the current value detected by the current detection unit becomes a constant current, and wherein the constant voltage control operation controls the voltage set by the voltage setting unit so that the voltage output to the load becomes a constant voltage based on the voltage value that is fed back by the feedback unit, wherein the current detection unit detects a current value flowing in the load before discharge starts by applying a voltage to the image forming unit, and the current detection unit detects a sum of a current value flowing in the feedback unit and a current value flowing in the load after discharge starts by applying a voltage to the image forming unit.

2. The power source according to claim 1, wherein the control unit switches between the constant current control operation and the constant voltage control operation based on the current value detected by the current detection unit.

3. The power source according to claim 1, wherein the control unit switches between the constant current control operation and the constant voltage control operation based on a result of comparing a value calculated from the current value detected by the current detection unit with a reference value.

4. An image forming apparatus, comprising:

an image forming unit configured to execute an image formation operation;

a voltage setting unit configured to set a voltage to be output to the image forming unit;

a voltage generation unit configured to output the voltage set by the voltage setting unit to the image forming unit;

a feedback unit configured to detect the voltage output from the voltage generation unit to the image forming unit and feed back the detected voltage to the voltage setting unit;

a current detection unit configured to detect a current value, wherein the current value is a current value flowing in the image forming unit when the voltage set by the voltage setting unit is output to the image forming unit; and a control unit configured to switch between a constant current control operation and a constant voltage control operation, wherein the constant current control operation controls the voltage set by the voltage setting unit so that the current value detected by the current detection unit becomes a constant current, and wherein the constant voltage control operation controls the voltage set by the voltage setting unit so that the voltage output to the image forming unit becomes a constant voltage based on the voltage value that is fed back by the feedback unit, wherein the current detection unit detects a current value flowing in the load before discharge starts by applying a voltage to the image forming unit, and the current detection unit detects a sum of a current value flowing in the feedback unit and a current value flowing in the load after discharge starts by applying a voltage to the image forming unit.

5. The image forming apparatus according to claim 4, wherein the image forming unit includes an image carrier, a charging member configured to charge the image carrier, and an exposure unit configured to expose the image carrier with light, and wherein the control unit switches the constant current control operation to the constant voltage control operation in a case where it is determined that there is an abnormality in the exposure unit based on the current value detected by the current detection unit.

6. The image forming apparatus according to claim 4, wherein the image forming unit includes an image carrier and a transfer member configured to transfer an image formed on the image carrier to a sheet, and wherein the control unit calculates a current value flowing in the transfer member based on the current value detected by the current detection unit and selects the constant current control operation or the constant voltage control operation based on the calculated current value.

7. A voltage application circuit, comprising:

a voltage setting circuit configured to set an output voltage;

a transformer configured to output the voltage set by the voltage setting circuit to a load;

a feedback circuit configured to detect the voltage output by the transformer to the load and feed back the detected voltage to the voltage setting circuit;

a current detection circuit configured to detect a current value, wherein the current value is a sum of a current value flowing in the feedback circuit and a current value flowing in the load when the voltage set by the voltage setting circuit is output to the load; and a control unit configured to switch between a constant current control operation and a constant voltage control operation, wherein the constant current control operation controls the voltage to be set in the voltage setting circuit so that the current value detected by the current detection circuit becomes a constant current, and wherein the constant voltage control operation controls the voltage set in the voltage setting circuit so that the voltage output to the load becomes a constant voltage based on the voltage value that is fed back by the feedback circuit, wherein the control unit switches between the constant current control operation and the constant voltage control operation based on a comparison result of a predetermined current value and the current value detected by the current detection circuit.

8. A power source, comprising:

one transformer;

a driving part configured to drive a primary side of the one transformer so as to output a voltage from a secondary side of the one transformer, the driving unit part being connected to the primary side of the one transformer;

a voltage setting part configured to set a voltage output from a secondary side of the one transformer, the voltage setting part being connected to the primary side of the one transformer;

a current detecting part configured to detect a current value flowing in the secondary side of the one transformer; and a voltage detecting part configured to detect a voltage output from the secondary side of the one transformer, wherein the voltage setting part can switch between a constant voltage control operation according to a detection result of the voltage detection part and a constant current control operation according to a detection result of the current detecting part.

9. The power source according to claim 8, wherein the voltage setting part switches between the constant voltage control operation and the constant current control operation based on a detection result of the current detection part.

10. The power source according to claim 8, wherein the constant voltage control operation is that the voltage setting part controls a voltage so that a voltage output from the secondary side of the one transformer becomes constant according to a detection result of the voltage detection part and the constant current control operation is that the voltage setting part controls a current so that a current flowing in a load to which the voltage output from the secondary side of the one transformer is supplied becomes constant according to a detection result of the current detection part.

11. An image forming apparatus, comprising:

an image forming member configured to form an image; and a power source configured to apply a voltage to the image forming member, the power source comprising:

one transformer, a driving part configured to drive a primary side of the one transformer so as to output a voltage from a secondary side of the one transformer, the driving part being connected to the primary side of the one transformer, a voltage setting part configured to set a voltage output from a secondary side of the one transformer, the voltage setting part being connected to the primary side of the one transformer;

a current detecting part configured to detect a current value flowing in the secondary side of the one transformer, and a voltage detecting part configured to detect a voltage output from the secondary side of the one transformer, wherein the voltage setting part can switch between a constant voltage control operation according to a detection result of the voltage detection part and a constant current control operation according to a detection result of the current detecting part.

12. The image forming apparatus according to claim 11, wherein the image forming member includes an image carrier and a charging unit configured to charge the image carrier, and wherein, when a voltage is output from the secondary side of the one transformer to the charging unit, the voltage setting part switches to the constant current operation in a case where the current value detected by the current detection unit is smaller than a threshold value, and the voltage setting part switches to the constant voltage control operation in a case where the current value detected by the current detection unit is equal to or larger than the threshold value.

13. The image forming apparatus according to claim 11, wherein the image forming member includes an image carrier and a transfer unit configured to transfer an image formed on the image carrier, and wherein, when a voltage is output from the secondary side of the one transformer to the transfer unit, the voltage setting part switches to the constant voltage control operation in a case where the current value detected by the current detection unit is larger than a threshold value, and the voltage setting part switches to the constant current control operation in a case where the current value detected by the current detection unit is equal to or smaller than the threshold value.

14. The image forming apparatus according to claim 11, wherein the constant voltage control operation is that the voltage setting part controls a voltage so that a voltage output from the secondary side of the one transformer becomes constant according to a detection result of the voltage detection part and the constant current control operation is that the voltage setting part controls a current so that a current flowing in the image forming member to which the voltage output from the secondary side of the one transformer is supplied becomes constant according to a detection result of the current detection part.

* * * * *